US006496676B1

(12) United States Patent
Caruthers, Jr. et al.

(10) Patent No.: US 6,496,676 B1
(45) Date of Patent: Dec. 17, 2002

(54) LIQUID DEVELOPER SYSTEM EMPLOYING A PRETRANSFER STATION

(75) Inventors: Edward B. Caruthers, Jr., Rochester, NY (US); George A. Gibson, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/885,548

(22) Filed: Jun. 20, 2001

(51) Int. Cl.[7] ..... G03G 15/16; G03G 15/10
(52) U.S. Cl. ..... 399/296; 399/237
(58) Field of Search ..... 399/296, 237, 399/340, 341, 342; 430/97, 104, 117, 124, 126

(56) References Cited

U.S. PATENT DOCUMENTS 4,218,246 A * 8/1980 Tanaka et al. ..... 430/126
5,232,812 A * 8/1993 Morrison et al. ..... 430/124
5,426,491 A * 6/1995 Landa et al. ..... 399/237

OTHER PUBLICATIONS

"Effects of Paper Properties on Liquid Toner Transfer", IS&T's NIP 15: 1999 Int'l Conference on Digital Printing Technologies by Ed Caruthers and Weizhong Zhao, pp. 642–645.

* cited by examiner

*Primary Examiner*—Joan Pendegrass
(74) *Attorney, Agent, or Firm*—Lloyd F. Bean, II

(57) ABSTRACT

A liquid electrophotographic reproduction machine including an image bearing member movable along a process path; latent image means mounted along the process path for forming a latent image electrostatically on the image bearing member; a development unit mounted along the process path and containing liquid developer material including a liquid carrier and dispersed charged toner particles for developing the latent image to form a toner image; a pre-transfer station for increasing adhesiveness of the toner image, the pre-transfer station includes an applicator member which applies a cohesion increasing (Cl) solution on the toner image; and a transfer station for transferring the toner image onto a receiving substrate.

16 Claims, 2 Drawing Sheets

LIQUID DEVELOPER SYSTEM EMPLOYING A PRETRANSFER STATION

BACKGROUND AND SUMMARY

This invention relates generally to liquid ink development of images in an electrostatographic printing machine, and more particularly, concerns a method for improving transfer of develop images onto receiving substrates.

Generally, the process of electrostatographic copying is initiated by exposing a light image of an original document onto a substantially uniformly charged photoreceptive member, resulting in the creation of a latent electrostatic image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a developed powder image on the photoreceptive member.

Alternatively, liquid developing materials comprising a liquid carrier having toner particles immersed therein have been successfully utilized to develop electrostatic latent images, wherein the liquid developing material is applied to the photoconductive surface with the toner particles being attracted toward the image areas of the latent image to form a developed liquid image on the photoreceptive member. Regardless of the type of developing material employed, the toner particles of the developed image are subsequently transferred from the photoreceptive member to a copy substrate, either directly or by way of an intermediate transfer member. Thereafter, the image may be permanently affixed to the copy substrate for providing a "hard copy" reproduction or print of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, as distinguished from so-called light lens generated image systems which develop toner on the charged areas, also known as CAD, or "write white" systems. The subject invention applies to both such systems.

The use of liquid developer materials in imaging processes is well known. Likewise, the art of developing electrostatographic latent images formed on a photoconductive surface with liquid developer materials is also well known. Indeed, various types of liquid developing materials and liquid based development systems have heretofore been disclosed with respect to electrostatographic printing machines.

Liquid developers have many advantages, and often produce images of higher quality than images formed with dry developing materials. For example, the toner particles utilized in liquid developing materials can be made to be very small without the resultant problems typically associated with small particle powder toners, such as airborne contamination which can adversely affect machine reliability and can create potential health hazards. The use of very small toner particles is particularly advantageous in multicolor processes wherein multiple layers of toner generate the final multicolor output image.

Further, full color prints made with liquid developers can be processed to a substantially uniform finish, whereas uniformity of finish is difficult to achieve with powder toners due to variations in the toner pile height as well as a need for thermal fusion, among other factors. Full color imaging with liquid developers is also economically attractive, particularly if surplus liquid carrier containing the toner particles can be economically recovered without cross contamination of colorants.

Liquid developer material typically contains about 2 percent by weight of fine solid particulate toner material dispersed in the liquid carrier, typically a hydrocarbon. After development of the latent image, the developed image on the photoreceptor may contain about 12 percent by weight of the particulate toner in the liquid hydrocarbon carrier. However, at this percent by weight of toner particles, developed liquid images tend to exhibit poor cohesive behavior which results in image smear during transfer. In addition, partial image removal, or so-called scavenging, is problematic during successive liquid development steps, particularly in image-on-image color processes. In order to prevent image scavenging and to improve the quality of transfer of the developed image to a copy sheet, the liquid developing material making up the developed liquid image may be "conditioned" by compressing or compacting the toner particles in the developed image and removing carrier liquid therefrom for increasing the toner solids content thereof. The liquid toner image may be conditioned on the surface of a development member, before developing the electrostatic image on the photoreceptor; on the surface of the photoreceptor, after development; and/or on the surface of an intermediate transfer member. We will generally provide examples of conditioning on the photoreceptor surface, but it should be understood that these methods may also be used to condition the image on other surfaces. Liquid ink conditioning greatly improves the ability of the toner particles to form a high resolution image on the final support substrate or an intermediate transfer member, if one is employed.

Various devices and systems are known for effectively conditioning liquid developing materials in electrostatographic systems. In one exemplary system particularly relevant to the present invention, a device and method for increasing the solid content of an image formed from a liquid developer is provided, wherein an absorptive blotting material is contacted with the developed liquid image. A vacuum source is coupled to the blotting material so that absorbed liquid dispersant is drawn through the blotting material. The absorptive blotting material is preferably provided in the form of a covering on a porous conductive roller which is biased with an electrical charge having a polarity which is the same as the charge of the toner particles in the developing material, such that the resulting electric field repels the toner particles from the absorptive blotting material for transferring so that minimal toner particles adhere thereto.

Although various systems have been developed for conditioning an image in liquid based electrostatographic printing systems, some problems and inadequacies remain with respect to known electrostatically based systems. In particular, notwithstanding blotting rolls add additional equipment, thus increasing the cost and complexity of the marking engine. This additional cost and complexity is even greater if vacuum is used. And the blotting may disturb the image: some toner particles may transfer to the blotting roll; the high pressure from the roll and from the roll's electrical bias may push some toner laterally on the surface of the photoreceptor.

SUMMARY OF INVENTION

The present invention is directed toward liquid electrophotographic reproduction machine including an image bearing member movable along a process path; latent image means mounted along the process path for forming a latent image electrostatically on said image bearing member; a development unit mounted along the process path and containing liquid developer material including a liquid carrier and dispersed charged toner particles for developing the latent image to form a toner image; an intermediate transfer member and a transfer station for transferring the toner image from the photoreceptor to the intermediate transfer member; a pre transfer station for increasing the cohesiveness of the toner image on the intermediate transfer member; a transfix station for transferring and fixing the toner image to the final copy substrate (e.g., paper, transparency, canvas, cloth); and a cleaning station for removing untransferred toner from the photoreceptor. The pre-transfer station may include an applicator member that applies a cohesion increasing (Cl) solution on the toner image and it may include a corona producing member that increases the cohesion of the toner layer.

DESCRIPTION OF THE DRAWINGS

Other aspects of the present invention will become apparent as the following description proceeds and upon reference to the drawings, in which:

For a general understanding of the features of the present invention, reference is made to the drawings, wherein like reference numerals have been used throughout to designate identical elements. FIG. 1 shows a schematic elevational view of a full-color, liquid developing material based electrostatographic printing machine incorporating the features of the present invention.

Inasmuch as the art of electrostatographic printing is well known, the various processing stations employed in the printing machine of FIG. 1 will be described only briefly with reference thereto while the present description will focus on a detailed description of the particular features of the cohesion increasing image conditioning system of the present invention. It will become apparent from the following discussion that the apparatus of the present invention may also be well-suited for use in a wide variety of systems, devices, apparatus and machines and is not necessarily limited in its application to the field of electrostatographic printing or the particular liquid developing material-based electrostatographic machine described herein.

Figure 1:
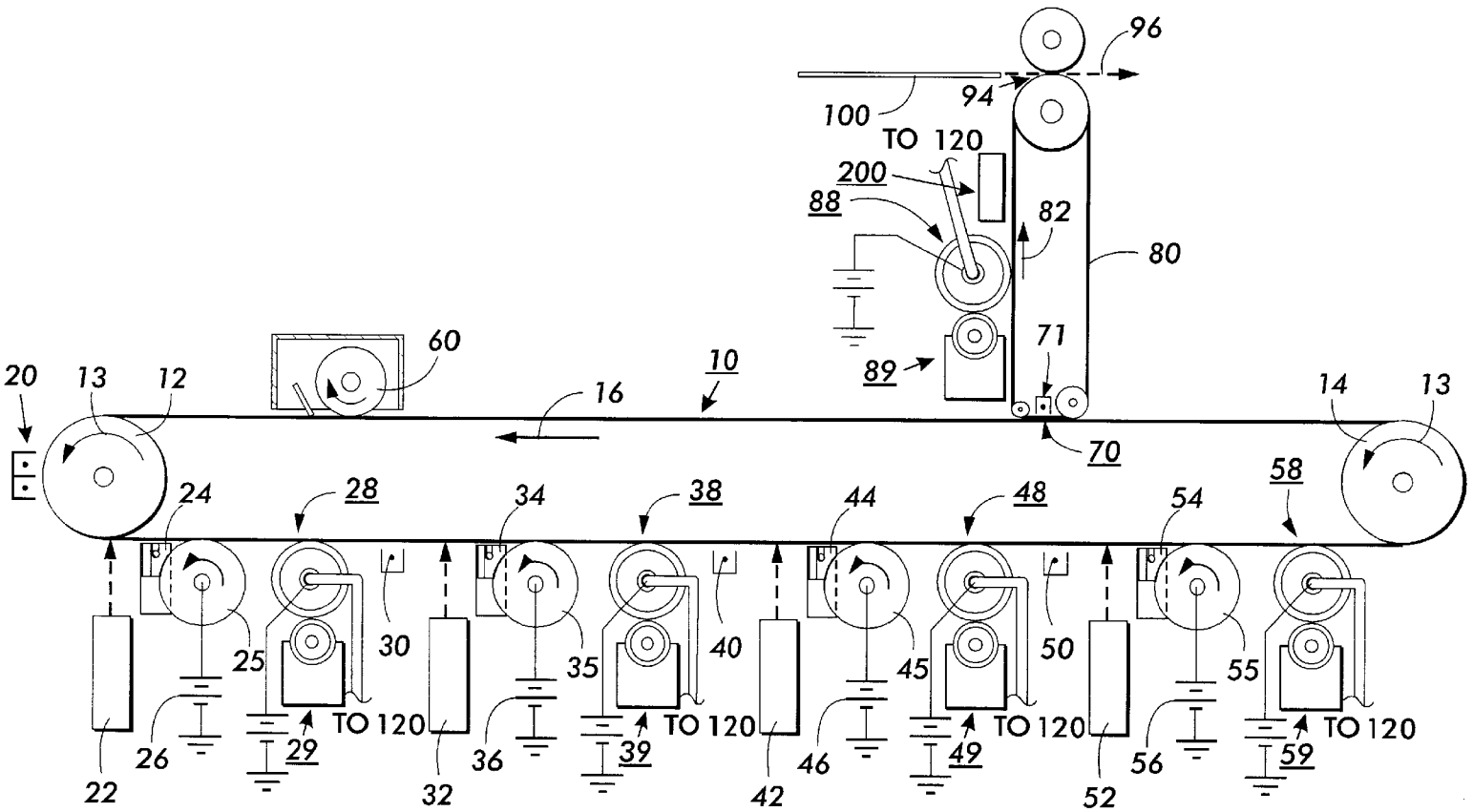
FIG. 1 is a schematic, elevational view of a liquid ink-based image-on-image color electrostatographic printing machine incorporating a cohesion increasing (Cl) image conditioning system in accordance with the present invention.

Turning now to FIG. 1, the multicolor electrostatographic printing machine shown employs a photoreceptive belt 10 which is transported in the direction of arrow 16, along a curvilinear path defined by rollers 12 and 14. These rollers are driven in the direction of arrows 13 for advancing successive portions of the photoreceptive belt 10 sequentially through the various processing stations disposed about the path of movement thereof. Initially, the belt 10 passes through a charging station where a corona generating device 20 charges the photoconductive surface of belt 10 to relatively high, substantially uniform electrical potential. After the substantially uniform charge is placed on the photoreceptive surface of the belt 10, the printing process proceeds by either placing an input document from a transparent imaging platen (not shown), or by providing a computer generated image signal for discharging the photoconductive surface in accordance with the image information to be generated.

The present description is directed toward a Recharge, Expose, and Develop (REaD) color imaging process, wherein the charged photoconductive surface of photoreceptive member 10 is serially exposed by a series of individual raster output scanners (ROSs) 22, 32, 42, and 52 to record a series of latent images thereon. The photoconductive surface is continuously recharged and re-exposed to record latent images thereon corresponding to the subtractive primary of another color of the original. Each latent image is serially developed with appropriately colored toner particles until all the different color toner layers are deposited in superimposed registration with one another on the photoconductive surface. It will be recognized that this REaD process represents only one of various multicolor processing techniques that may be used in conjunction with the present invention, and that the present invention is not intended to be limited to REaD processing or to multicolor processes.

In the exemplary electrostatographic system of FIG. 1, each of the color separated electrostatic latent images are serially developed on the photoreceptive belt 10 via a fountain-type developing apparatus 24, 34, 44 and 54, which may be of the type disclosed, for example in U.S. Pat. No. 5,579,473, wherein appropriately colored developing material is transported into contact with the surface of belt 10. Each different color developing material is comprised of charged toner particles disseminated through the liquid carrier, wherein the toner particles are attracted to the latent image areas on the surface of belt 10 by electrophoresis for producing a visible developed image thereon. Generally, in a liquid developing material-based system, the liquid carrier medium makes up a large amount of the liquid developing composition. Specifically, the liquid medium is usually present in an amount of from about 80 to about 98 percent by weight, although this amount may vary from this range. By way of example, the liquid carrier medium may be selected from a wide variety of materials, including, but not limited to, any of several hydrocarbon liquids, such as high purity alkanes, including Norpar.®. 12, Norpar.®. 13, and Norpar.®. 15, and including isoparaffinic hydrocarbons such as Isopar.®. G, H, L, and M, available from Exxon Corporation. Other examples of materials suitable for use as a liquid carrier include Amsco.®. 460 Solvent, Amsco.®. OMS, available from American Mineral Spirits Company, Soltrol.®., available from Phillips Petroleum Company, Pagasol.®., available from Mobil Oil Corporation, Shellsol.®., available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures.

The toner particles can be any pigmented particle compatible with the liquid carrier medium, such as those contained in the developing materials disclosed in, for example, U.S. Pat. Nos. 3,729,419; 3,968,044; 4,476,210; 4,794,651; and 5,451,483, among numerous other patents. The toner particles preferably have an average particle diameter from about 0.2 to about 10 microns, and more usually from about 0.5 to about 2 microns. The toner particles may be present in amounts of from about 0.5 to about 10 percent by weight, and usually from about 1 to about 4 percent by weight of the developer composition. The toner particles can consist solely of pigmented particles, or may comprise a resin and a pigment; a resin and a dye; or a resin, a pigment, and a dye.

Dyes generally are present in an amount of from about 5 to about 30 percent by weight of the toner particle, although other amounts may be present provided that the objectives of the present invention are achieved. Generally, any pigment material is suitable provided that it consists of small particles that combine well with the polymeric material also included in the developer composition. Pigment particles are generally present in amounts of from about 5 to about 40 percent by weight of the toner particles, and usually from about 10 to about 30 percent by weight. In addition to the liquid carrier vehicle and toner particles which typically make up the liquid developer materials suitable for use in a liquid developing material based electrostatographic machine, a charge control additive (sometimes referred to as a charge director) may also be included for facilitating and maintaining a uniform charge on toner particles by imparting an electrical charge of selected polarity (positive or negative) to the toner particles.

The charge control additive may be present in an amount of from about 0.01 to about 3 percent by weight, and usually from about 0.02 to about 0.05 percent by weight of the developer composition. The developer station may also include a metering roll 25, 35, 45, 55 situated adjacent to a corresponding developer fountain 24, 34, 44, 54 and in close proximity to the surface of photoreceptive belt 10.

The metering roll generally rotates in a direction opposite the movement of the photoconductor surface so as to exert a shear force on the liquid developed image in the area of the nip formed between the surface of the photoreceptor and the metering roll. This shear force removes an initial amount of liquid developing material from the surface of the photoreceptor so as to minimize the thickness of the developing material thereon. The excess developing material removed by the metering roll eventually falls away from the rotating metering roll for collection in a sump, not shown. A DC power supply 26, 36, 46, 56 may also be provided for maintaining an electrical bias on the metering roll at a selected polarity for enhancing image development.

Each of the developer stations shown in FIG. 1 are substantially identical to one another and represent only one of various known apparatus or systems that can be utilized to apply liquid developing material to the photoconductive surface or other image recording medium. After image development, it is generally desirable that the liquid developed image be processed or conditioned to compress the image and to remove additional excess liquid carrier therefrom, as shown, for example, by U.S. Pat. Nos. 4,286,039 and 5,493,369, among various other patents. This so-called "image conditioning" process is directed toward increasing the solids percentage of the image, and can advantageously increase the solids percentage of the image to a range of approximately 25% or higher. An exemplary apparatus for image conditioning is depicted at reference numerals 28, 38, 48 and 58, each comprising a roller member which preferably includes a porous body and a perforated skin covering. In addition, the image conditioning rolls 28, 38, 48 and 58 are typically conductive and biased to a potential having a polarity which repels the charged toner particles of the liquid developed image to compress the image and to inhibit the departure of toner particles therefrom. In an exemplary image conditioning system of U.S. Pat. No. 5,332,642, incorporated by reference herein, a vacuum source 120 may also be provided, coupled to the interior of the roller, for creating an airflow through the porous roller body to draw liquid carrier from the surface of the photoreceptor 10 for enhancing the process of increasing the percentage of toner solids in the developed image.

In operation, rollers 28, 38, 48 and 58 rotate in contact with the liquid image on belt 10 such that the porous body of roller 28 absorbs excess liquid from the surface of the image through the pores and perforations of the roller skin covering. The vacuum source draws liquid through the roller skin to a central cavity, wherein the collected liquid may be deposited in a receptacle or some other location which permits either disposal or re-circulation of the liquid carrier. The porous roller is thus continuously discharged of excess liquid to provide constant removal of liquid from the developed image on belt 10. During the removal of excess liquid from the developed image on photoreceptor 10, a small amount of toner and other contaminants may transfer to rollers 28, 38, 48, and 58. The amount of toner transferred depends on the bias applied thereto and the properties of the materials employed therein. Transferred toners can result in materials degradation and may be transferred back to the image carrier, such as photoreceptor 10 or an intermediate transfer member (identified by reference numeral 80) to cause ghost images. To prevent these problems the vacuum assisted blotter roll stations incorporate cleaning rolls and waste collection boxes, denoted 29, 39, 49, and 59.

Moving on the with the discussion of illustrative multicolor printing system, imaging, development and image conditioning are repeated for subsequent color separations by recharging and reexposing the belt 10 via charging devices 30, 40, and 50 as well as exposure devices 32, 42, and 52, whereby color image information is superimposed over the previous developed image. For each subsequent exposure an adaptive exposure processing system may be employed for modulating the exposure level of the raster output scanner (ROS) 32, 42, or 52 for a given pixel as a function of the developing material previously developed at the pixel site, thereby allowing toner layers to be made independent of each other, as described in U.S. Pat. No. 5,477,317.

The re-exposed image is next advanced through a corresponding development station and subsequently through an associated image conditioning station, for processing in the manner previously described. Each step is repeated as previously described to create a multilayer image made up of black, yellow, magenta, and cyan toner particles as provided via each developing station. It should be evident to one skilled in the art that the color of toner at each development station could be provided in a different arrangement. It will be similarly evident that the present invention can be used in marking engines including only one color, in marking engines containing black and one or more spot colors (e.g., metallic colors, Pantone> colors, varnishes), in marking engines containing 6 process colors ("hexachrome"), and in marking engines containing four process colors plus other spot colors. After the multilayer image is created on the photoreceptive member 10, it may be advanced to an intermediate transfer station 70 for transferring the image from the photoconductive belt 10 to the intermediate transfer member.

Thereafter, the intermediate transfer member continues to advance in the direction of arrow 82 to a transfer nip 94 where the developed image is transferred and affixed to a recording sheet 100 transported through nip 94 in the direction of arrow 96. While the image on the photoreceptor 10, after image conditioning thereof, and consequently the image transferred to the intermediate transfer member 80, has a solids percentage in the range of approximately 25%, the optimal solids content for transfer of a liquid image to a copy substrate is above approximately 50%. This solids percentage insures minimal hydrocarbon emissions from an image bearing copy substrate and further advantageously minimizes or eliminates carrier showthrough on the copy substrate.

Thus, it is also desirable to remove excess liquid from the developed image on the intermediate 80, prior to transfer of that image to the copy sheet 100. To that end, prior to transfer of the image from the intermediate transfer member, the liquid developed image thereon may, once again be conditioned in a manner similar to the image conditioning process described with respect to image conditioning apparatus 28, 38, 48, and 58.

Thus, as shown in FIG. 1, an additional image conditioning apparatus 88 is provided adjacent the intermediate transfer member 80 for conditioning the image thereon.

Figure 2:
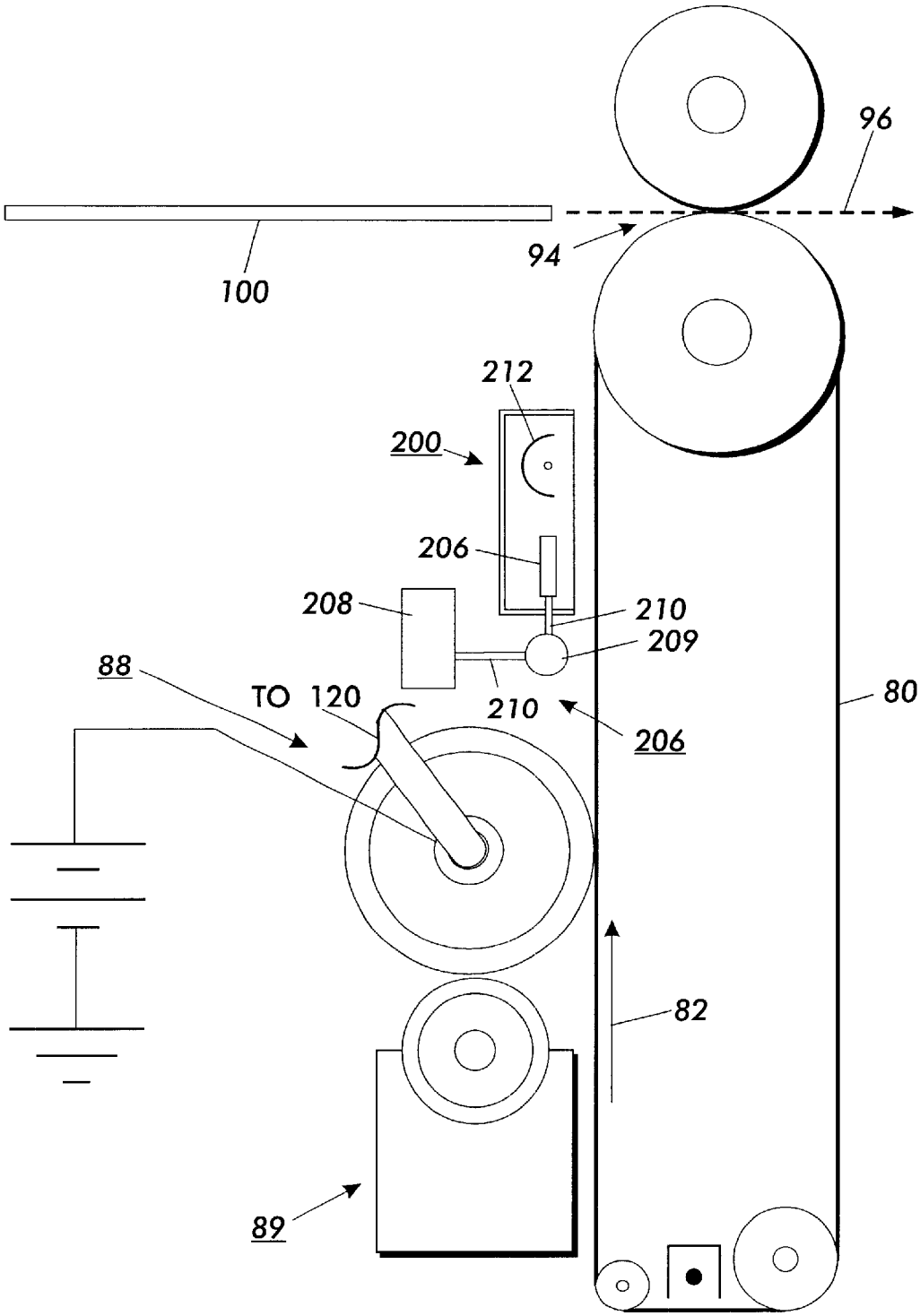
FIG. 2 is a schematic elevational view of an exemplary embodiment of an intermediate transfer system including an intermediate transfer belt (ITB), a corotron for transferring the image to the ITB, a cohesion increasing image conditioning system in accordance with the present invention, and a transfix station for transferring and fixing the image onto the final substrate.

Next, the image moves to pre-transfer station 200. The detailed structure of the pre transfer station 200 will be described hereinafter with reference to FIG. 2.

Pre-transfer station 200 includes an applicator member 206 which applies a cohesion increasing (Cl) solution on the image. Applicator member 202 can be in the form of a spray nozzel, or an applicator roll (either forward or reverse turning). A replenishing system supplies the Cl solution to applicator member 206. Replenishing system 206 includes a holder tank 208 to hold the Cl solution; a pump 209 to pump the Cl via tube 210 to the applicator member 202. The Cl solution is selected based on the type of toner used, for example in the treatment of polyester toners with ester solvents (Propyl acetate or Ethyl Acetate for example) will depress the $T_g$ and/or $T_m$ of the materials rendering them more adhesive. The solvents can be removed subsequently by diffusion from the image and evaporation. Styrenic resins will be similarly effected by aromatic solvents such as xylene. Toners containing significant wax will be similarly effected by appropriate aliphatic solvents. Pre-transfer station 200 includes preferrably a corona device 212, applicants have found corona discharge onto treated image may improve image stability by increasing particle to particle cohesion. The applicants have not identified the mechanism of this improvement but speculate it may involve cross linking of polymer chains.

The pre-transfer station can be enabled or disabled based on the copy substrate being used. For example, transfer of liquid toner images to rougher, more porous substrates is more difficult than transfer to smoother, less porous substrates. Liquid toner images are especially likely to "break up" when transferred to rough, porous substrates. This "break up" causes breaks in lines and text and small white spots in solid areas. Depending on total system design, Cl image conditioning may only be needed for transfer to rougher, more porous substrates. Properties of some common substrates are given in "Effects of Paper Properties on Liquid Toner Transfer," by E. Caruthers and W. Zhao, IS&T's NIP 15: 1999 Int'l Conference On Digital Printing Technologies.

Thereafter pre-transfer station 200, transfer of the liquid developed image from the intermediate transfer member to the copy substrate 100 can be carried out by any suitable technique conventionally used in electrophotography, such as corona transfer, pressure transfer, bias roll transfer, and the like. It will be understood that transfer methods such as adhesive transfer, or differential surface energy transfer, wherein the receiving substrate has a higher surface energy with respect to the developing material making up the image, can also be employed.

After the developed image is transferred to intermediate member 80, residual liquid developer material may remain on the photoconductive surface of belt 10. A cleaning station 60 is therefore provided, which may include a roller formed of any appropriate elastomer that may be driven in a direction opposite to the direction of movement of belt 10, for scrubbing the photoconductive surface clean. It is common to supply carrier liquid to the cleaning roller and to provide a cleaning blade after the cleaning roller, to remove carrier fluid from the photoreceptor surface before printing the next image. It will be understood, however, that a number of photoconductor cleaning devices exist in the art, any of which would be suitable for use with the present invention. In addition, any residual charge left on the photoconductive surface may be extinguished by flooding the photoconductive surface with light from a lamp (not shown) in preparation for a subsequent successive imaging cycle. In this way, successive electrostatic latent images may be developed. The foregoing discussion provides a general description of the operation of a liquid developing material based electrostatographic printing machine which advantageously incorporates the system for cohesion increasing image conditioning of the present invention.

While the present invention will be described in the context of REaD development onto a photoreceptor belt and intermediate transfer onto the final copy substrate, it will be understood by those skilled in the art that it may also be applied to other forms of lonographic and electrostatographic printing. For example, four photoreceptors could be used with four transfers to an intermediate transfer member (belt or drum), followed by Cl image conditioning, transfer to the final copy substrate, and subsequent fusing of the image on the final copy substrate. As another example, if the photoreceptor is not harmed by the Cl solution, then this invention can be used to increase image cohesion on the photoreceptor. As another example, if the present invention is used to increase image cohesion on the photoreceptor, then it can be used with systems that directly transfer the toner image from the photoreceptor to the final copy substrate. As another example, the present invention may be used to increase cohesion of images formed after ink jet or other direct marking methods have been used to form a non-electrophotographic image on an intermediate transfer member, prior to transfer to the final copy substrate. Other examples will occur to those skilled in the art of non-impact printing.

The method and apparatus described herein fully satisfies the aspects of the invention hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. A liquid electrophotographic reproduction machine comprising:

(a) an image bearing member movable along a process path;

(b) latent image means mounted along the process path for forming a latent image electrostatically on said image bearing member;

(c) a development unit mounted along the process path and containing liquid developer material including a liquid carrier and dispersed charged toner particles for developing the latent image to form a toner image;

(d) a cohesion increasing pre transfer station for increasing adhesiveness of an image prior to transfer to a final copy substrate, said pre-transfer station includes an applicator member that applies a cohesion increasing (Cl) solution containing a solvent to the image; and e) a transfer station for transferring said toner image onto a receiving substrate.

2. The liquid electrophotographic reproduction machine of claim 1, wherein said pre-transfer station further includes a replenishing system for supplying the Cl solution to applicator member.

3. The liquid electrophotographic reproduction machine of claim 2, wherein said replenishing system includes a holder tank to hold the Cl solution and a pump to pump the AC via a tube to the applicator member.

4. The liquid electrophotographic reproduction machine of claim 1, wherein said Cl solution comprises ester solvents when said image contains polyester resins.

5. The liquid electrophotographic reproduction of claim 1, wherein said Cl solution comprises aromatic solvents when said image contains Styrenic resins.

6. The liquid electrophotographic reproduction machine of claim 1, wherein said pre-transfer station further includes a corona device for applying corona onto the toner image to increase adhesion.

7. A liquid electrophotographic reproduction machine comprising:

(a) an image bearing member movable along a process path;

(b) latent image means mounted along the process path for forming a latent image electrostatically on said image bearing member;

(c) a development unit mounted along the process path and containing liquid developer material including a liquid carrier and dispersed charged toner particles for developing the latent image to form a toner image;

(d) a pre transfer station for increasing cohesiveness of the toner image, said pre-transfer station includes an applicator member which applies a cohesion increasing (Cl) solution containing a solvent on the toner image; and e) a transfer station for transferring said toner image onto a receiving substrate.

8. The liquid electrophotographic reproduction machine of claim 7, wherein said pre-transfer station further includes a replenishing system for supplying the Cl solution to applicator member.

9. The liquid electrophotographic reproduction machine of claim 8, wherein said replenishing system includes a holder tank to hold the Cl solution and a pump to pump the Cl solution via a tube to the applicator member.

10. The liquid electrophotographic reproduction machine of claim 7, wherein said Cl solution comprises ester solvents when said toner image comprises polyester toners.

11. The liquid electrophotographic reproduction machine of claim 7, wherein said Cl solution comprises aromatic solvents when said toner image comprises styrenic resin toners.

12. The liquid electrophotographic reproduction machine of claim 7, wherein said pre-transfer station further includes a corona device for applying corona onto the toner image to increase adhesion.

13. A liquid ink printing machine comprising:

(a) an image bearing member movable along a process path;

(b) means mounted along the process path for forming an image on said image bearing member; and (c) a cohesion increasing station for increasing adhesiveness of said image, said cohesion station includes an applicator member that applies a cohesion increasing (Cl) solution containing a solvent to the image.

14. The liquid ink printing machine of claim 13, wherein said Cl solution comprises ester solvents when said image contains polyester resins.

15. The liquid ink printing machine of claim 13, wherein said Cl solution comprises aromatic solvents when said image contains Styrenic resins.

16. The liquid ink printing machine of claim 13, further includes a corona device for applying corona onto the toner image to increase adhesion.

* * * * *